US008020334B2

(12) United States Patent
Delmonico

(10) Patent No.: US 8,020,334 B2
(45) Date of Patent: Sep. 20, 2011

(54) MODULAR MOUNTING SYSTEMS FOR RIFLE ACCESSORIES, AND ASSOCIATED EQUIPMENT

(75) Inventor: Ernest Delmonico, N. Scituate, RI (US)

(73) Assignee: Tactical Ordnance Group, Inc., North Scituate, RI (US)

( * ) Notice: Subject to any disclaimer, the term of this patent is extended or adjusted under 35 U.S.C. 154(b) by 216 days.

(21) Appl. No.: 12/384,250

(22) Filed: Apr. 3, 2009

(65) Prior Publication Data

US 2009/0277069 A1 Nov. 12, 2009

Related U.S. Application Data

(60) Provisional application No. 61/071,590, filed on May 7, 2008, provisional application No. 61/136,526, filed on Sep. 11, 2008.

(51) Int. Cl.
*F41C 27/06* (2006.01)
*F41C 23/16* (2006.01)

(52) U.S. Cl. ..... 42/105; 42/72

(58) Field of Classification Search ..... 42/71.01, 42/72, 73, 77, 85, 90, 105, 124, 127, 146
See application file for complete search history.

(56) References Cited

U.S. PATENT DOCUMENTS

| | | | | |
|---|---|---|---|---|
| 445,192 | A * | 1/1891 | Nye et al. | 42/71.01 |
| 789,403 | A * | 5/1905 | Aitken | 42/71.01 |
| 4,367,606 | A * | 1/1983 | Bechtel | 42/127 |
| D283,433 | S * | 4/1986 | Bechtel | D22/110 |
| 4,733,489 | A | 3/1988 | Kurak | |
| 5,198,600 | A | 3/1993 | E'Nama | |
| 5,417,002 | A * | 5/1995 | Guerra | 42/72 |
| 6,598,331 | B1 * | 7/2003 | Thibodeaux | 42/111 |
| 6,854,206 | B2 | 2/2005 | Oz | |
| 2004/0000083 | A1 * | 1/2004 | Grant, Jr. | 42/112 |
| 2005/0217161 | A1 * | 10/2005 | Haugen et al. | 42/124 |
| 2005/0241212 | A1 * | 11/2005 | Swan | 42/127 |
| 2006/0179701 | A1 * | 8/2006 | Mossberg et al. | 42/77 |
| 2007/0044365 | A1 * | 3/2007 | Deken | 42/146 |

* cited by examiner

*Primary Examiner* — Bret Hayes
(74) *Attorney, Agent, or Firm* — Michael de Angeli

(57) ABSTRACT

Accessory mounting structure for securing accessory mounting rails to the barrel or other forward structure of a weapon comprises cooperatively shaped mounting ring halves that are secured to another over the barrel of the weapon. Accessory mounting rails are then secured to the mounting rings. Where the weapon is a grenade launcher, a quick-reload mechanism may additionally be provided.

8 Claims, 7 Drawing Sheets

MODULAR MOUNTING SYSTEMS FOR RIFLE ACCESSORIES, AND ASSOCIATED EQUIPMENT

CROSS-REFERENCE TO RELATED APPLICATIONS

This application claims priority from provisional application Ser. Nos. 61/071,590, filed May 7, 2008, and 61/136,526, filed Sep. 11, 2008.

FIELD OF THE INVENTION

In a first aspect, this application relates to systems for convenient mounting of accessories onto weapons, typically rifles, so as to allow ready reconfiguration of the weapon to suit a particular mission. More specifically, the invention provides a mounting structure that is attachable to a standard grenade launcher, itself having previously been mounted on a rifle, and which then will accept one or more mounting rails of standard design which will then accept standard additional accessories. A similar device may also be used for mounting similar rails to other weapons, for example for attachment of standard mounting rails to the barrels or other structure of shotguns and other weapons.

In a second aspect of the invention, a quick-reload breech opening mechanism for the standard grenade launcher is incorporated into the system for mounting of accessories, providing further improvement in efficiency.

BACKGROUND OF THE INVENTION

It is well known to mount accessory equipment to standard rifles in order to add capabilities to suit particular circumstances or mission requirements. For example, Kurak U.S. Pat. No. 4,733,489 shows a way in which a grenade launcher can be conveniently secured to the barrel of an automatic rifle. It is also known to secure a rail of standard design to the barrel of the rifle which in turn will accept accessories, such as lights, lasers, sights, grenade and flare launchers, that are adapted to be secured to the rail of standard design. See E'Nama U.S. Pat. No. 5,198,600. One such rail of standard design is the "Picatinny rail", apparently so-called because it was developed at the U. S. Army's Picatinny Arsenal. See Oz U.S. Pat. No. 6,854,206, which teaches attachment of a Picatinny or "Weaver" rail to the front sight of any of a family of automatic rifles.

Ser. No. 61/071,590 provided a further improvement over the art discussed above by provision of a mounting structure comprising at least two mounting rings each made up of mating ring halves, to be attached to an existing grenade launcher already having been mounted on a rifle. The mounting structure of the invention then accepts one or more Picatinny-type or other standard mounting rails, which in turn can accept any of a variety of accessories, such as gripping handles, laser or infrared sights, flashlights, and the like.

One standard grenade launcher used by the US armed forces, the so-called M203, comprises a receiver, a barrel assembly, and a trigger assembly. The trigger assembly is fixed to the receiver, while the barrel assembly slides forward to allow ejection of a spent round and insertion of a fresh round. In order to allow the barrel assembly to slide forward, it is necessary for the soldier to operate a catch fixed to the receiver. This requires the soldier to hold the weapon in one hand and operate the catch with the other, which is awkward. It would be preferable to provide a mechanism which would allow the soldier to release the barrel of the grenade launcher and slide it forward without moving either hand from its normal firing positions.

SUMMARY OF THE INVENTION

In a first aspect of the present invention, a further improvement is provided over the art discussed above by provision of a mounting structure comprising at least two mounting rings each made up of mating ring halves, to be attached to an existing grenade launcher already having been mounted on a rifle. The mounting structure of the invention then accepts one or more Picatinny-type or other standard mounting rails, which in turn can accept any of a variety of accessories, such as gripping handles, laser or infrared sights, flashlights, and the like.

According to a further aspect of the present invention, a similar mounting structure comprising at least two mounting rings each made up of mating ring halves can be adapted to be attached to the forward portion of the stock or the barrel(s) of a shotgun or other weapon; one or more Picatinny-type or other standard mounting rails, which in turn can accept any of a variety of accessories, such as gripping handles, laser or infrared sights, flashlights, and the like, can then be affixed to the clamping rings.

According to a third aspect of the present invention, a simple mechanism is provided for single-handed opening of the breech of a standard grenade launcher that can be readily added to the accessory mounting system discussed above without impeding the other useful features thereof, and without requiring modification of the grenade launcher or rifle.

BRIEF DESCRIPTION OF THE DRAWINGS

The invention will be understood if reference is made to the accompanying drawings, in which.

DESCRIPTION OF THE PREFERRED EMBODIMENTS

Figure 1:
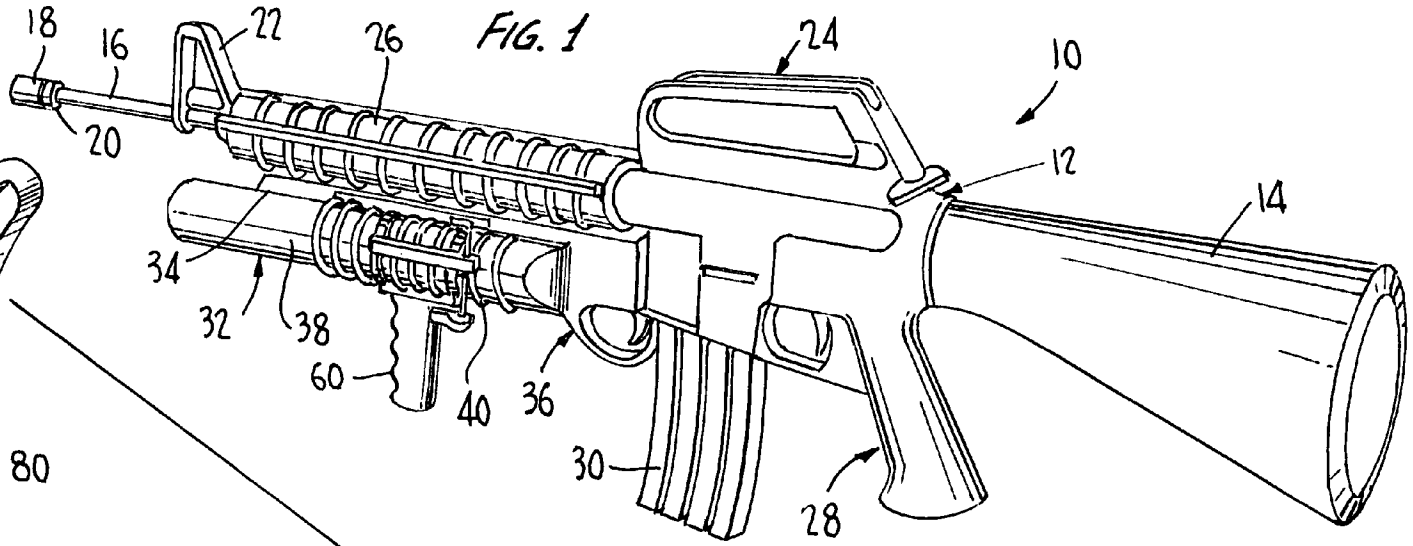
FIG. 1 is a perspective view of an automatic rifle having had a grenade launcher fitted thereto, with which the invention can be used.

FIG. 1 illustrates an assembly of an automatic rifle 10 and a grenade launcher 32 with which the present invention may be used. In the illustration, the rifle is the M16 and the grenade launcher is the model M203; this combination is commonly used by the U.S. military. Although the invention is shown herein as useful with this combination of rifle and grenade launcher, the invention is not limited thereto. A forward hand grip 60 is shown attached to the grenade launcher according to the invention, as detailed below, although the details of the mounting structure according to the invention are not shown in FIG. 1.

The rifle 10 includes a central breech portion 12, a butt 14 extending rearwardly from the breech portion 12, a barrel 16 extending forwardly from the breech portion 12, a flash arrester 18 at the forward end 20 of barrel 16, a forward sight 22, a transport handle 24 which includes a rear sight (not shown), a hand guard 26 intermediate the forward sight 22 and the transport handle 24, a grip and trigger assembly 28, and a magazine 30. The rifle 10 is shown as having a grenade launcher 32 affixed to the rifle 10 beneath the hand guard 26. The grenade launcher can be affixed to the rifle 10 using the structure taught by the Kurak patent or otherwise. The grenade launcher 32 includes a trigger mechanism portion 36, a barrel 38, and its own hand guard 40 encircling a portion of the barrel 38.

More specifically, as shown in FIGS. 2-4 and 6-8, the hand guard portion 40 of the grenade launcher 32 is generally cylindrical, and its surface is configured to define a series of spaced raised rings 42 that are generally semicircular in cross section. Between the raised rings are exposed sections 44 of the cylindrical barrel of the grenade launcher. The grenade launcher 32 shown is provided with a generally rectangular receiver 32*a*, discussed further below, that mates with conventional structure on the rifle 10. According to one aspect of the invention, accessories such as a hand grip 60 can conveniently be mounted securely to the grenade launcher 32.

According to the present invention, at least two mounting rings 48 are assembled to the hand guard portion 40 of the grenade launcher. As illustrated by FIGS. 3-5 and 8, each mounting ring 48 is made up of corresponding ring halves 50 and 52, assembled to one another by screws 54 extending from one ring half into a threaded bore in the other; preferably screws 54 are captive so as not to be lost. The ring halves 50 and 52 are substantially similar in shape, but are made in left and right versions so as to securely mate with one another and with the hand guard portion 40 of the grenade launcher 32. The detailed design of the ring halves is further discussed below in connection with FIG. 5. As shown, the ring halves 50 and 52 are generally L-shaped in cross-section, so as to define inwardly-extending rings fitting securely between the raised rings 42 of the hand guard portion 40.

After the ring halves 50 and 52 have thus been assembled to the hand guard portion 40 of the grenade launcher 32, one or more accessory mounting rails 56 may be secured to the mounting rings 48 thus formed. Preferably three accessory mounting rails 56 are employed, to ensure rigidity of the assembly. As illustrated, the rails 56 are secured to the clamping rings 48 by screws 58 extending into tapped holes 80 (FIG. 5) in the ring halves 50 and 52. The cross-sectional profile of the outer section of the rails 56 shown conform to the popular "Picatinny rail" design, so that various accessories designed to be mounted on the standard Picatinny rail are useful with the mounting structure of the invention without modification. However, the overall length, hole spacing, and other details may differ from the government's actual specifications for the Picatinny rail. The rails employed in the preferred embodiment may be referred to as "Picatinny-type" rails, for simplicity. Nor, of course, is the invention to be limited to Picatinny-type rails.

Figure 2:
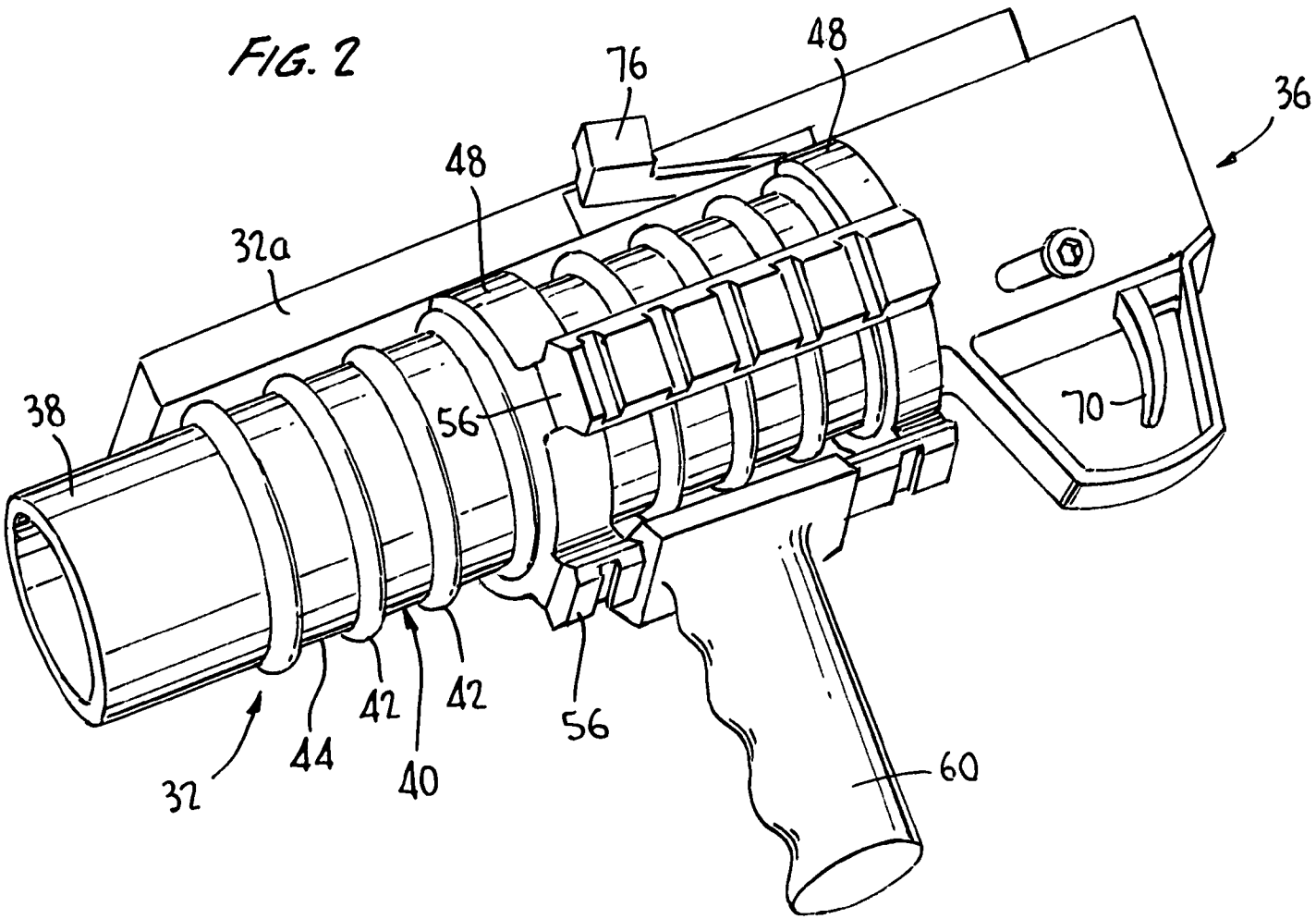
FIG. 2 is a perspective schematic view of a grenade launcher in the breech-closed configuration, further having the accessory mounting structure of the invention secured thereon and having a forward hand grip attached thereto.
Figure 3:
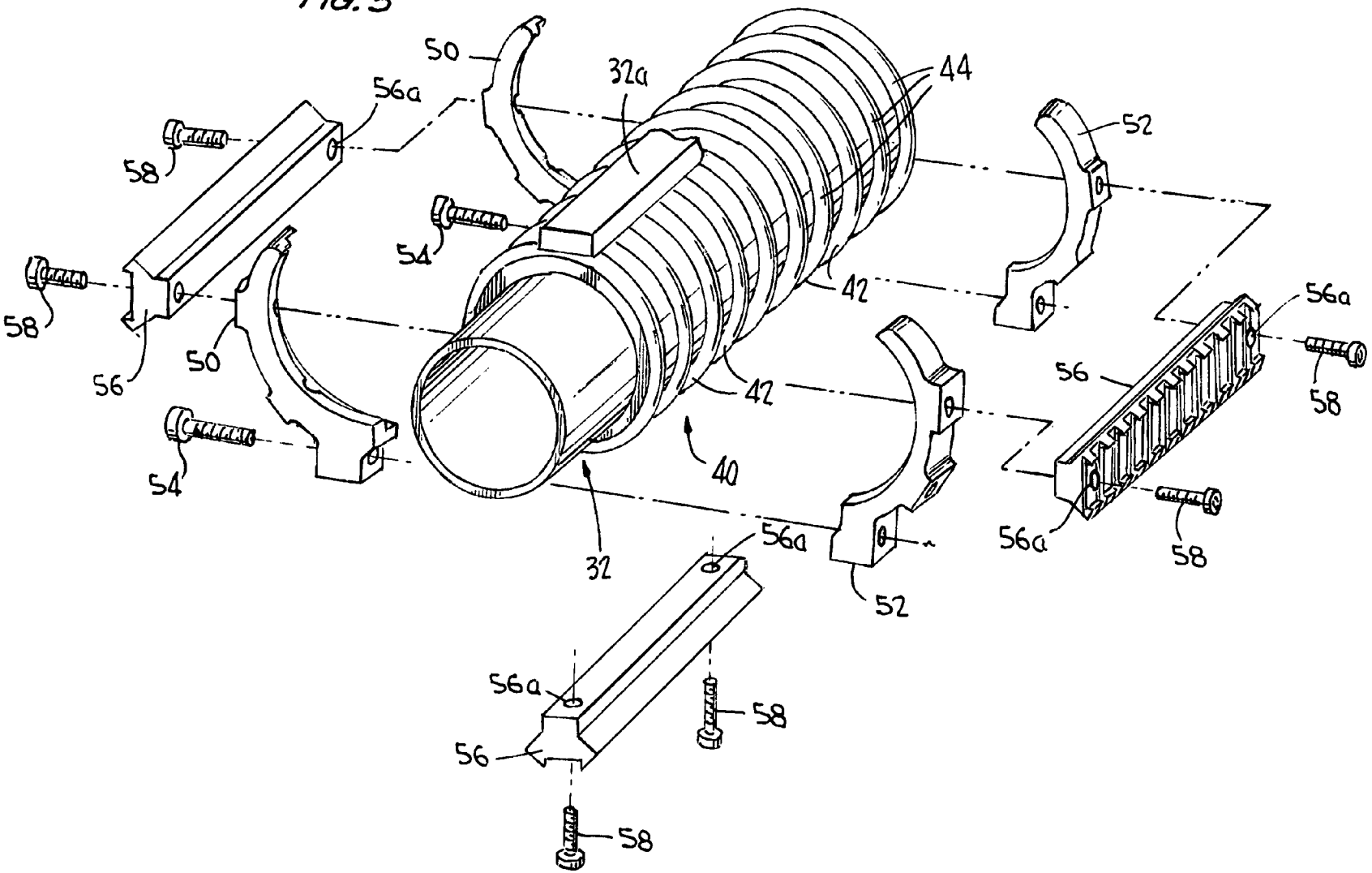
FIG. 3 is a perspective drawing of an exploded view of the accessory mounting structure of the invention around the tube of a grenade launcher.
Figure 4:
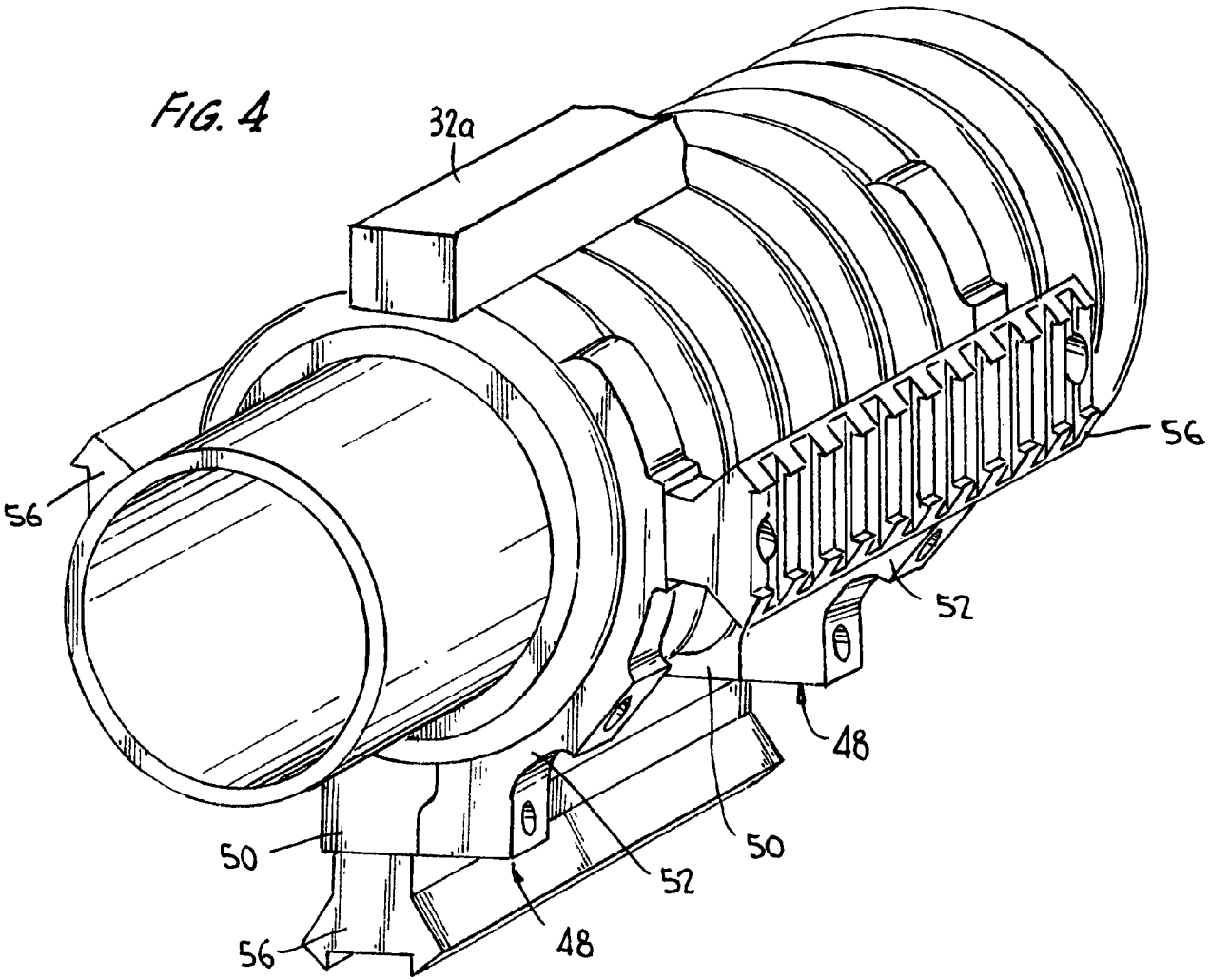
FIG. 4 is a view similar to FIG. 3, showing the components of the accessory mounting structure of the invention assembled to the grenade launcher, in one possible configuration.

FIG. 2 shows a grenade launcher 32 to which two of the mounting rings 48 of the accessory rail mounting structure of the invention have been affixed. Three Picatinny-type rails 56 (only two being visible in FIG. 2) have then been secured to the mounting rings 48. As mentioned, various accessories are commercially available that are normally intended to be secured to Picatinny rails affixed to the rifle itself. These accessories can instead be secured to the grenade launcher by virtue of the addition of the accessory rail mounting structure of the invention. Thus these accessories can be provided on the weapon together with a grenade launcher; in the prior art, it would not have been possible to provide a weapon having been fitted with a grenade launcher with such additional accessories.

FIG. 2 illustrates the assembly of a gripping handle 60 to one of the three Picatinny-type rails 56 secured to the accessory mounting structure of the invention, having been secured to the handguard portion of a grenade launcher according to the invention, but of course the invention is not to be limited to this or any particular accessory; flashlights and laser sights are nonlimiting further examples of accessories that might usefully be so mounted to a rifle.

Figure 5:
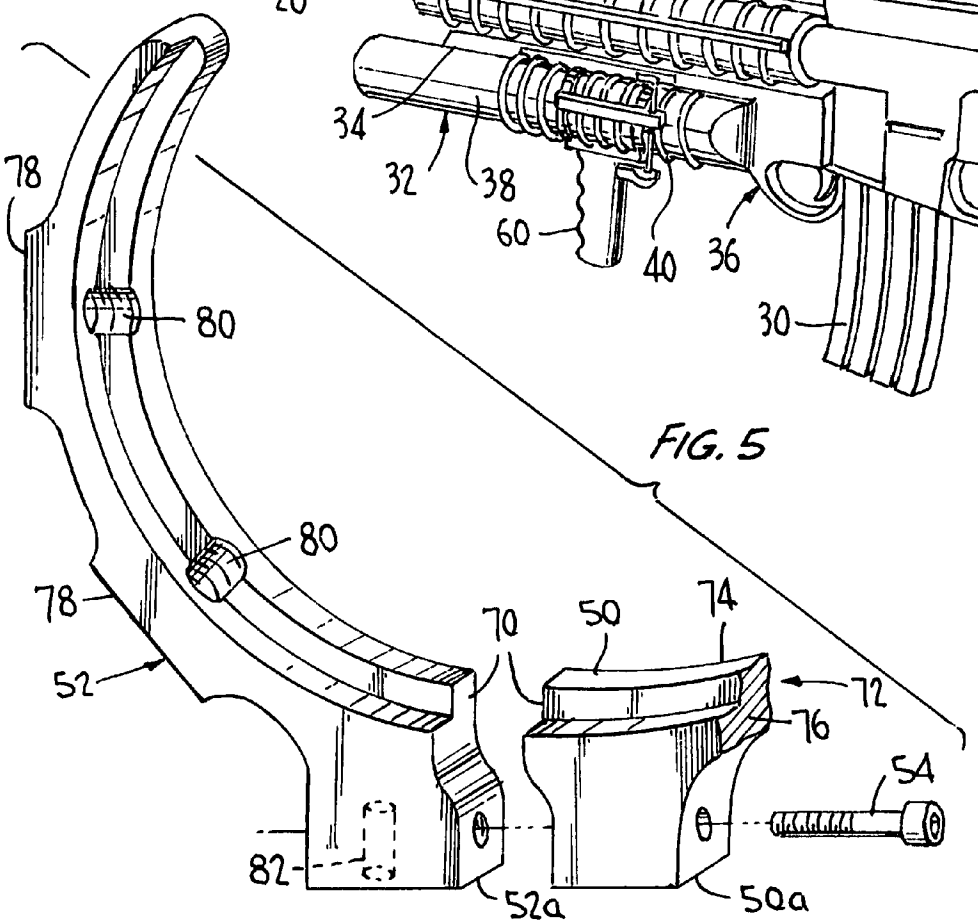
FIG. 5 shows an enlarged perspective view of one of the mounting ring halves of the accessory mounting structure of the invention, and a partial view of the mating ring half.

FIG. 5 shows an enlarged view of a "right" ring half 52, and of a portion of the mating "left" ring half 50. Preferably, the ring halves are machined of military-specification type 7075 aluminum and anodized. As illustrated, the ring halves 50 and 52 meet at mating surfaces, formed in radially-widened sections 50*a* and 52*a* of ring halves 50 and 52, that are cooperatively contoured so that relative slipping is prevented despite the ring halves being secured to one another by a single clamping screw 54.

The interior surface of the assembled ring halves 50 and 52, making up the completed mounting rings 48, corresponds closely to the outer surface of the grenade launcher or other weapon to which the assembled ring is attached, so that the mounting ring 48 is securely clamped to the barrel of the weapon when the assembly is made. Typically each of the mating ring halves 50 and 52 of each of the at least two mounting rings will be identical (that is, all of the "left" ring halves 50 intended to fit a particular type of weapon will be identical to one another, as will all of the "right" ring halves 52) for convenience in manufacture.

Where the ring is to be affixed to a grenade launcher 32, the circular portions of the mounting ring halves are preferably L-shaped in cross-section as shown at 72 (FIG. 5); the portion 74 of the L extending radially inwardly mates securely with the cylindrical barrel portion 44 (FIG. 2) of the hand guard of the grenade launcher, while the portion 76 extending axially provides additional stiffness. Two or more flat-surfaced bosses 78 are provided on each ring half for receiving the Picatinny rails 56, which are secured thereto by screws extending through holes 56*a* in the rails into tapped holes 80 in the ring halves.

It will be apparent that the spacing of the holes 56*a* in the rails 56 must be chosen in accordance with the spacing of the raised portions 42 of the handguard so that the rings fit therebetween. A similar tapped hole 82 may be provided in the radially-widened sections 50*a*, 52*a* to receive an additional Picatinny rail. Hence, in this preferred embodiment, there are five possible points at which Picatinny-style rails may be attached.

As mentioned above, it is usually preferred that the completed assembly comprise at least two mounting rings 48 and at least three rails, to stiffen the assembly. As shown in FIGS. 2 and 6-8, accessories such as a forward grip 52 can be readily attached to the Picatinny-type rail 66 assembled to the grenade launcher by sliding a correspondingly-shaped slot in its base over the rail 66 and tightening a clamp (not shown). Such accessories for being mounted on Picatinny-type rails are commercially available.

It is also within the scope of the invention to employ similar structure to mount Picatinny-type or other accessory mounting rails to the barrels of other types of weapons. For example, the generally circular clamps shown in the Figs. hereof, which have generally circular interior surfaces to be assembled readily and securely to a grenade launcher, can instead be shaped to conform to other weapons, e.g. oval to fit over the side-by-side barrels of double-barreled shotguns, or otherwise to be securely attached to forward structure of a weapon, such as a wooden or plastic stock, enabling the mounting of Picatinny-type rails and convenient mounting of accessories such as forward hand grips.

According to another aspect of the invention, as mentioned above, it is desired to provide a quick-reload capability for the grenade launcher, whereby the awkward sequence of steps requiring both hands to be used to open the breech of an existing grenade launcher is eliminated in favor of a simple one-handed operation.

As above, FIG. 2 shows the grenade launcher in the breech-closed configuration, in which it is ready for firing. In this position the rear end of the barrel 38 of the grenade launcher 32 is juxtaposed to a trigger and firing pin assembly 36, such that when the trigger 70 is pulled, a firing pin 72 (FIG. 6) impacts the grenade and fires the charge.

Figure 6:
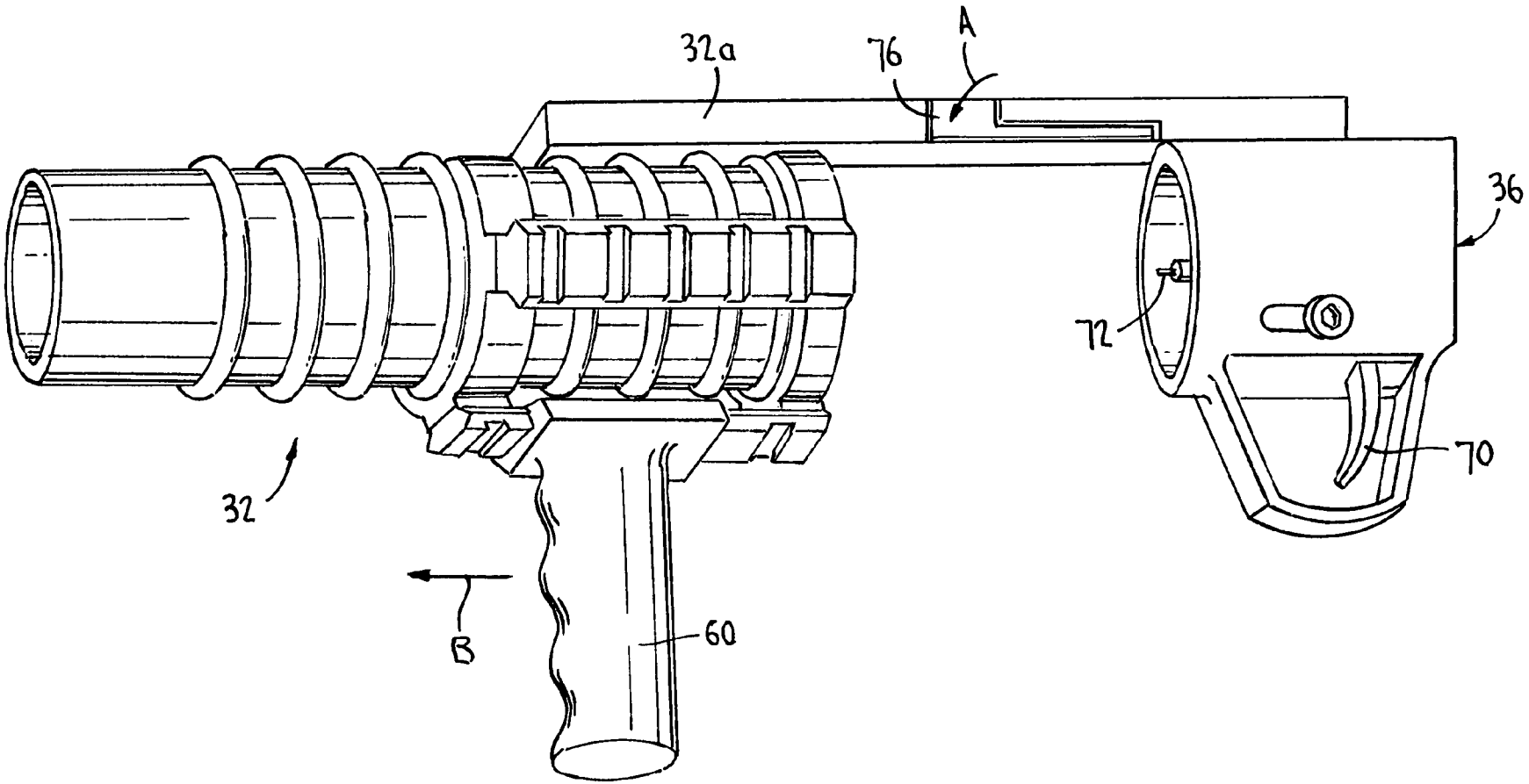
FIG. 6 is a view similar to FIG. 2, showing the grenade launcher in the breech-open configuration.

In order to eject the spent grenade cartridge and/or insert a fresh cartridge, the breech must be opened, to the position shown in FIG. 6. In the M203 grenade launcher, the breech is released by depressing a spring-loaded release lever 76, as illustrated by arrow A in FIG. 6, and is opened by pushing the barrel and handguard forwardly, as illustrated by arrow B. If a forward grip 60 is fitted, as shown, this can be gripped to open the breech. It will be appreciated that this would require the soldier to take his or her left hand off the forward grip (assuming the usual right-handed shooting position), push the lever 76 inwardly, and then move his or her left hand back to the forward grip 60 to push the assembly of grip 60 and barrel 40 forwardly, while holding the rifle in the right hand. This is awkward, and the release lever 76 may resecure the breech before the assembly of grip 60 and barrel 40 is pushed forwardly. It is the object of this invention to simplify this operation and make it essentially foolproof. Moreover, it is essential that this capability be provided without any modification to the standard grenade launcher.

Figure 7:
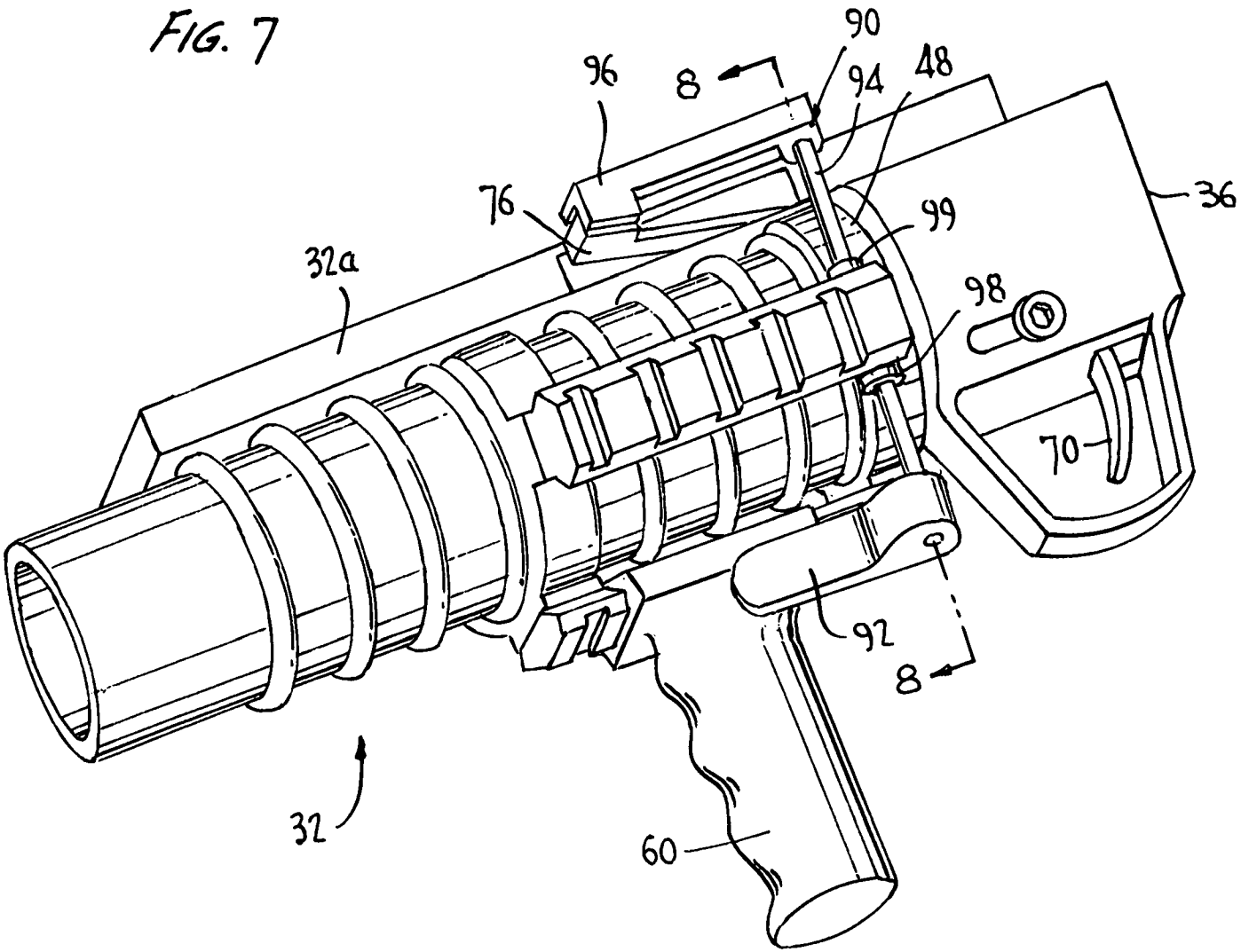
FIG. 7 is a view similar to FIG. 2, further showing a preferred embodiment of a mechanism according to the present invention for allowing convenient opening of the breech of the grenade launcher.
Figure 8:
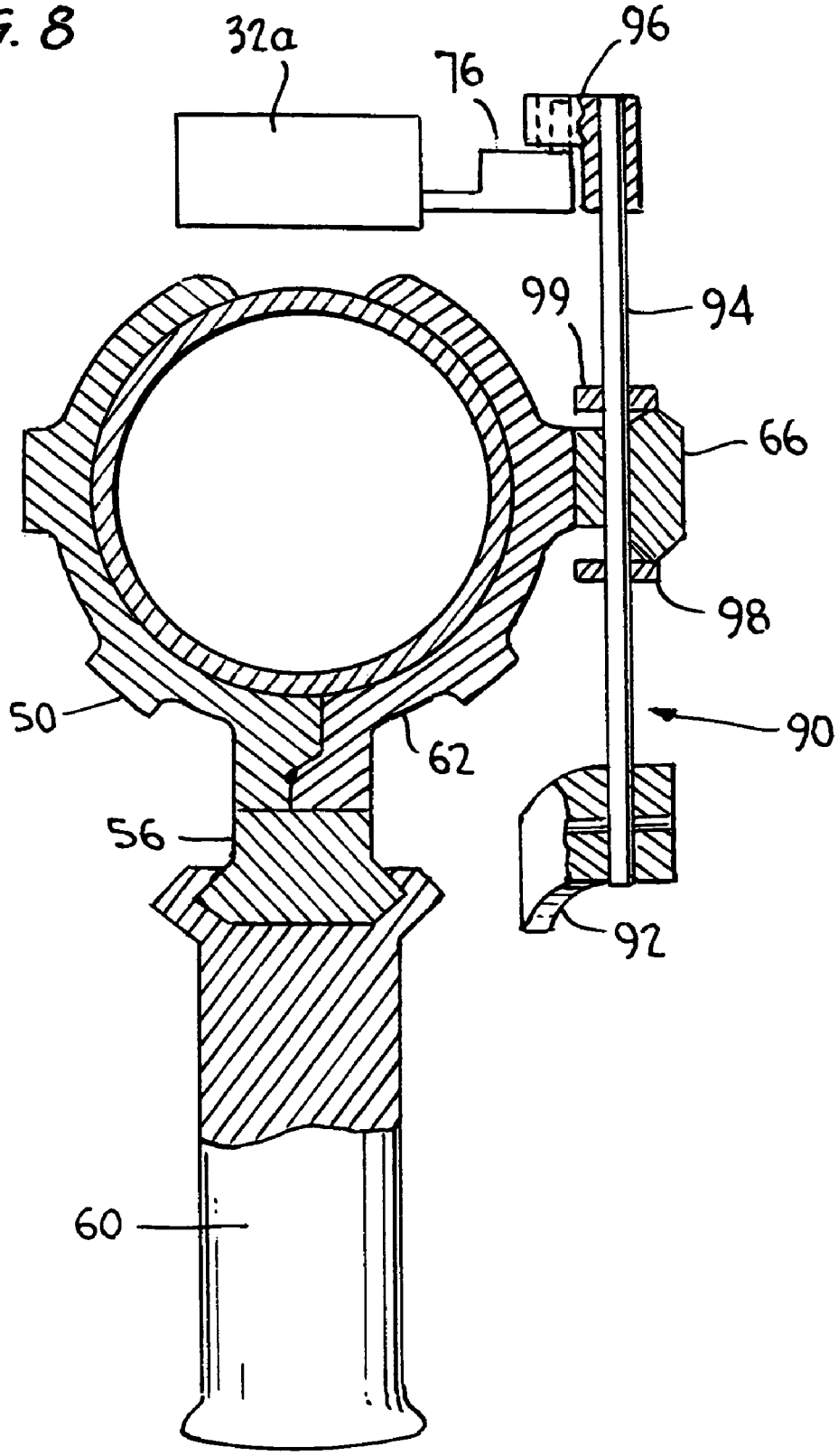
FIG. 8 is a schematic cross-sectional view taken along line 8-8 of FIG. 7.

According to this aspect of the present invention, as shown in FIGS. 7 and 8, a quick-reload mechanism 90 is provided, which allows the soldier to actuate the release lever 76 without moving his or her left hand from the forward grip 60; accordingly he or she can simply actuate the quick-reload mechanism 90 and then open the breech of the grenade launcher by pushing forward on the forward grip 60. In the embodiment shown, to which the invention is not limited, quick-reload mechanism 90 comprises a finger-actuated lever 92 disposed near the forward grip 60, an actuating arm 96, arranged to actuate the breech release lever 76, and a cross shaft 94 connecting the finger-actuated lever 92 and the actuating arm 96.

Lever 92 and actuating arm 96 are both fixed to shaft 94, by any of a variety of expedients. For example, finger-actuated lever 92, which may be made of aluminum, may be affixed to shaft 94 by setscrews or roll pins; if, as preferred, actuating arm 96 and shaft 94 are both steel, they can be welded or silver-soldered to one another. Shaft 94 pivots in a bore formed in a suitably-modified Picatinny-type rail 66 (see FIG. 8) and is confined axially by shaft collars 98, or the equivalent. Actuating arm 96 is located over release lever 76.

Thus, when the soldier presses down on lever 92, using either thumb or forefinger, which he or she may do without moving his or her left hand from its ordinary shooting position on forward grip 60, actuating arm 96 depresses release lever 76, freeing the barrel of the grenade launcher 32 to move with respect to receiver 32*a*. The soldier can then open the breech of the grenade launcher by pushing forwardly on the grip 60.

Preferably, actuating arm 96 is formed to include a hook for fitting around and under the forward end of release lever 76, so that the quick-reload mechanism 90 is retained in the active position shown, rather than pivoting outwardly. Otherwise, a spring could be provided to control the rest position of the mechanism 90. The finger-actuated lever 92 could also be shaped differently than as shown, to enable the soldier to reach it conveniently with his or her thumb; a more complicated mechanism transferring movement of the finger-actuated lever 92 to the actuating arm 96 might also be preferred. These and numerous other mechanisms that would similarly satisfy the objective of the invention—again, to allow the soldier to open the breech of the grenade launcher without moving his or her hand from the forward grip—are within the skill of the art and the scope of the invention. Nor, of course, is the invention to be limited to the specific combination of M16-type rifles and M203 grenade launcher.

While a preferred embodiment of the invention has been described in detail, the invention is not to be limited thereto; all modifications and improvements that are within the skill of the art and of the following claims are within the scope of the invention.

What is claimed is:

1. In combination, a grenade launcher including an elongated barrel defining a central axis of elongation, wherein the barrel of said grenade launcher comprises a cylindrical barrel portion having a hand guard thereover, said hand guard comprising a series of spaced parallel raised rings, and an accessory mounting structure for being affixed to said cylindrical barrel portion of said grenade launcher, without requiring drilling or other permanent modification of the grenade launcher, said accessory mounting structure comprising:

at least two mounting rings, each mounting ring being made up of two mating ring halves, one of said mating ring halves comprising a threaded bore and the other comprising a bore for receiving a threaded fastener, whereby said ring halves can be secured to one another and together define a C-shaped inside surface contacting the cylindrical barrel portion of said grenade launcher in the interstices between the spaced parallel raised rings, so as to be clamped securely thereto;

said mounting ring halves each comprising at least two bosses for receiving one or more separate accessory mounting rails, such that when the at least two mounting rings are clamped around and spaced along the cylindrical barrel portion of said grenade launcher, the bosses are spaced circumferentially around the mounting rings and spaced from one another parallel to the axis of elongation of the cylindrical barrel portion of said grenade launcher, whereby at least two accessory mounting rails can be secured to said mounting rings, providing plural locations at which accessories can be securely received.

2. The combination of claim 1, wherein said bosses define flat surfaces on the outer periphery of said mounting ring halves for mating with flat undersurfaces comprised by said accessory mounting rails, said bosses further defining threaded bores for receiving threaded fasteners for securing said accessory mounting rails to said mounting rings.

3. The combination of claim 2, wherein said mounting ring halves are cooperatively shaped so as to meet at a parting surface that is contoured such that the mounting ring halves can be fixed securely to one another using a single screw threaded into a bore in one of the mating ring halves.

4. The combination of claim 3, wherein the portions of said mounting ring halves that are cooperatively shaped so as to meet at a parting surface further comprise an additional boss for receiving an accessory mounting rail, whereby if the mounting rings are clamped around the forward structure of a weapon such that the parting surface is beneath the forward structure of the weapon in the normal position of use thereof, an accessory can be provided beneath the weapon.

5. The combination of claim 1, wherein the portions of said mounting ring halves which contact said cylindrical barrel portion are L-shaped in cross-section, with a flange extending radially inwardly for contacting the cylindrical barrel portion in the interstices between the spaced parallel raised rings.

6. The combination of claim 1, wherein said grenade launcher comprises a breech release lever that is actuated to open the breech of the grenade launcher, and wherein said accessory mounting structure further comprises a quick-reload mechanism including a finger-operated remote lever for actuating said breech release lever, enabling opening of the breech without the operator being required to directly actuate the breech release lever.

7. The combination of claim 6, wherein said quick-reload mechanism further comprises an actuating arm arranged to actuate the breech release lever and a cross shaft connecting said finger-actuated lever and said actuating arm.

8. The combination of claim 7, wherein said cross-shaft is received within a bore in one of said accessory mounting rails.

* * * * *